US006209233B1

(12) United States Patent
Crotts et al.

(10) Patent No.: US 6,209,233 B1
(45) Date of Patent: Apr. 3, 2001

(54) SAFEWAY DEEP UTILITY DITCH CLEANING MACHINE

(76) Inventors: Cecil L. Crotts; Houston T. Barnes, both of P.O. Box 1223, Flora Vista, NM (US) 87415

( * ) Notice: Subject to any disclaimer, the term of this patent is extended or adjusted under 35 U.S.C. 154(b) by 0 days.

(21) Appl. No.: 09/454,169

(22) Filed: Dec. 2, 1999

(51) Int. Cl.[7] ..... E02F 5/00; E01H 1/02
(52) U.S. Cl. ..... 37/352; 15/3
(58) Field of Search ..... 15/3, 80, 93.3; 37/91, 92, 93, 94, 95, 96, 97, 189, 363, 352, 347

(56) References Cited

U.S. PATENT DOCUMENTS

| | | | | |
|---|---|---|---|---|
| 1,241,880 | | 10/1917 | Pennington . | |
| 2,640,306 | | 6/1953 | Diehl | 55/17 |
| 4,109,336 | * | 8/1978 | Ford | 15/3 |
| 4,848,068 | * | 7/1989 | Staffanson | 56/12.7 |
| 4,872,275 | | 10/1989 | Beckett | 37/91 |
| 5,003,712 | * | 4/1991 | Mitchell | 37/91 |
| 5,027,534 | * | 7/1991 | Sackett | 37/91 |

* cited by examiner

*Primary Examiner*—Robert E. Pezzuto
(74) *Attorney, Agent, or Firm*—Robert K. Rhea

(57) ABSTRACT

A ditch cleaning apparatus is formed by a prime mover driving a chassis having endless metal belts for moving along the bottom of a vertical wall ditch and supporting an upright frame having a rearwardly and upwardly inclined elevator depositing debris on a first horizontal conveyor discharging debris laterally of a ditch position. A second horizontal conveyor, supported by the frame above the chassis, receives loose soil from the elevating conveyor for deposit on the ditch bottom rearwardly of the chassis. Sweep wings extend forwardly in diverging relation from the depending forward end of the elevating conveyor to guide debris toward the entrance end of the elevating conveyor. An operator position in the frame, above the upper limit of a ditch to be cleaned, is provided with controls for moving the machine and its several operating components in a ditch cleaning action.

4 Claims, 2 Drawing Sheets

108
56
64
106
104
79
97
90
57
65
102
96
86
92
95
74
63
56
68
71
52
100
36
49
42
57
69
75
51
84
40
20
84
40
20
74

108
59
65
102
104
86
92
58
64
106
97
94
90
63
73
81
55
84
80
70
72
54
84
74
77

SAFEWAY DEEP UTILITY DITCH CLEANING MACHINE

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to ditch cleaning machines, and more particularly to a ditch cleaning apparatus for cleaning debris from the bottom of a deep utility ditch.

1. Field of the Invention

Municipal lines are buried in relatively deep vertical wall ditches. In many locations the soil in these ditches is unstable as a result of sand or other formations tending to allow the walls of the ditch to cave-in. Since these ditch walls are some several feet above the height of workmen it creates a dangerous endeavor since utility contractors heretofore must rely on workmen entering such ditches to clean debris therefrom before installing a line.

This invention overcomes this problem by providing a ditch cleaning apparatus which maybe lowered by a boom into ditch and moved there along by an operator seated in the apparatus near or above the upper limit of the soil in which the ditch is formed and out of harms way in the event of a cave in. The apparatus is self propelled and moves longitudinally in a ditch to pick up debris from the bottom thereof and move it laterally of the ditch walls by deposit on the surface of the earth or in a suitable receptacle traveling with the debris removing apparatus.

2. Description of the Prior Art

U.S.Pat. No. 4,872,275 issued Oct. 10, 1989 to Beckett for Ditch Cleaning Machine discloses a machine which comprises a frame supported by a pair of inline forward and rearward wheels moving longitudinally in a ditch. The frame is supported against lateral tilting by outrigger wheels. The machine includes a pair of downward converging rotors cleaning the sides of upwardly diverging walls of an irrigation ditch, or the like, by elevating debris to a transversely disposed conveyor depositing the debris at a selected side of the ditch.

U.S. Pat. No. 1,241,880 issued Oct. 2, 1917 to Penington for Stone Gatherer and U.S. Pat. No. 2,640,306 issued Jun. 2, 1953 to Dietl for Stone Gathering Machine are believed to represent the further state-of-the-art. Both of these patents disclose a mobile frame having apparatus driving an elevator conveyor depositing gathered debris on a laterally projecting horizontal conveyor for depositing the debris in a receptacle moving with the frame or stone gathering machine.

This invention is believed distinctive over the above and other patents by providing a prime mover driving endless metal belts which are laterally moveable to compliment the width of the bottom surface of a vertical wall ditch and move longitudinally of the ditch throughout its length while supporting an upright frame having a rearwardly and upwardly inclined elevator depositing debris on an elevated horizontal laterally extending conveyor. An operator's position in the frame above the upper limit of a ditch is provided with controls for moving the apparatus and operating its several components.

BRIEF SUMMARY OF THE INVENTION

A self propelled ditch bottom cleaning apparatus is formed by a chassis supporting an upright frame and having pairs of sprocket wheels driving pairs of endless metal belts. The wheel and belt assemblies are pivotally connected with a central frame support panel for lateral spaced-apart adjustment in accordance with the width of the ditch bottom and are driven by an engine mounted in the frame. An elevating conveyor extends rearwardly and upwardly into the frame for depositing screened soil as pipe supporting berms on the ditch bottom and depositing debris on a laterally projecting horizontal conveyor discharging debris above the surface of the earth laterally of the position of the apparatus as it moves forwardly. Wing members at the forward end of the elevating conveyor converge rearwardly toward the entrance of the elevating conveyor and are controlled by the operator for diverting debris into the elevating conveyor.

The principal object of this invention is to provide a debris gathering and removing apparatus for cleaning utility ditches.

DETAILED DESCRIPTION OF THE INVENTION

Figure 1:
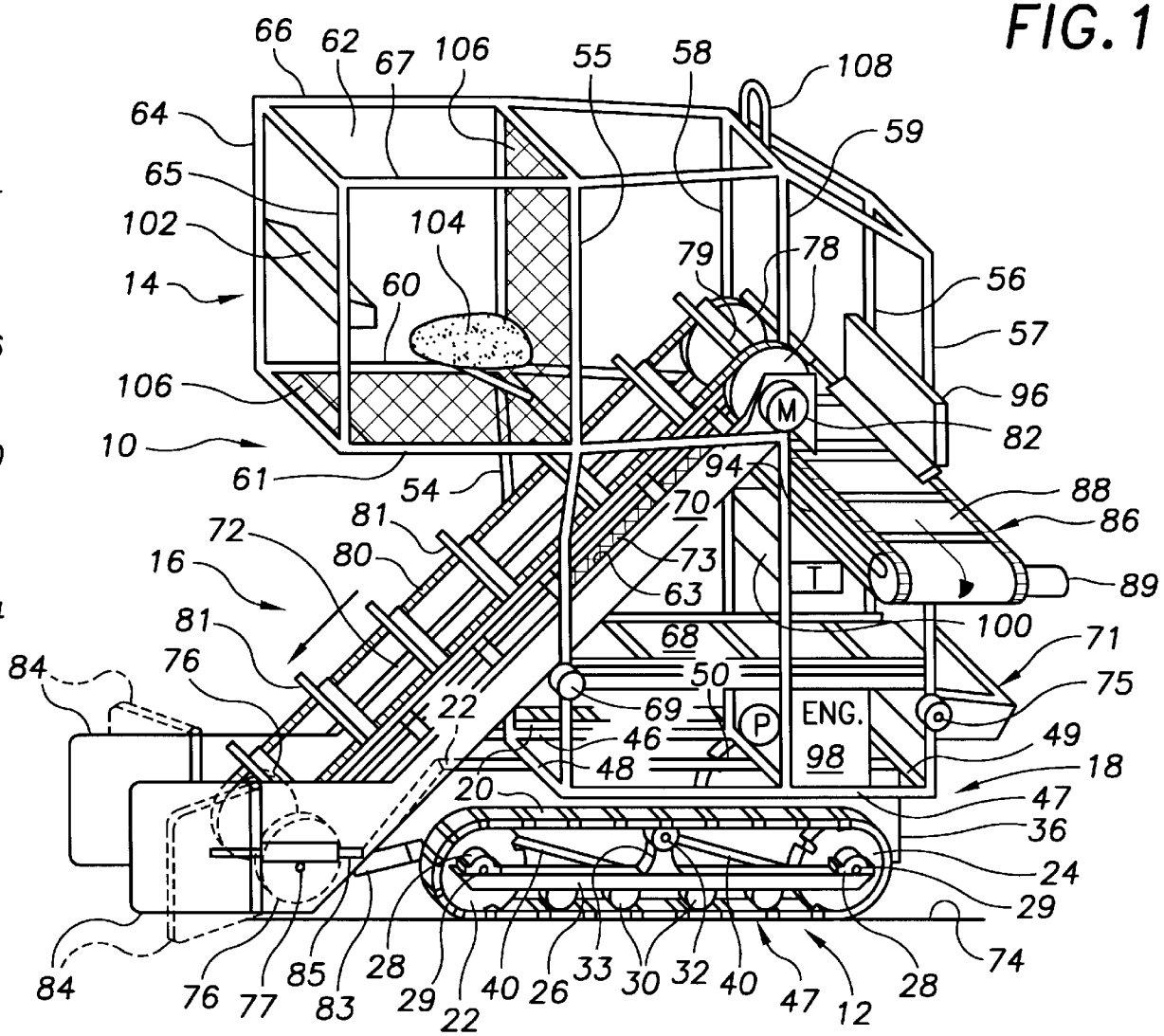
FIG. 1 is an isometric view of the apparatus.

Like characters of reference designate like parts in those figures of the drawings in which they occur.

In the drawings:

The reference numeral 10 indicates the apparatus as a whole comprising a chassis 12, including track means 20 connected with opposite sides of a chassis support panel 36 supporting an upstanding open framework means 14, conveyor means 16, 68 and 86 supported by the frame, and prime mover means 18 for driving the chassis and other components.

CHASSIS

The chassis means 12 includes pairs of laterally spaced front and rearward sprocket wheels 22 and 24, respectively having a stub axle 29, for driving the track means 20 in tractor fashion. The track means 20 comprises a pair of endless metal belts extending around the respective inline front and rearward sprocket wheels 22 and 24. An elongated wheel beam 26, only one being shown, extends longitudinally between the lateral outward side of respective inline forward and rearward wheels 22 and 24, on each side of the machi?ne, and is connected, at its respective ends, with the axle 29 of each pair of wheels 22 and 24 by pillow block bearings 28 journaling the lateral end portion the axles 29 of the respective pair of wheels 22 and 24. A series of rollers 30, only one example shown, depend from the beam 26 to further support the mass of the apparatus on the inward surface of the respective track 20. Similarly a roller 32 on a support 33 underlies the upper section of the respective track 20 in the fore-to-aft spacing between the pairs of wheels 22 and 24.

Figure 4:
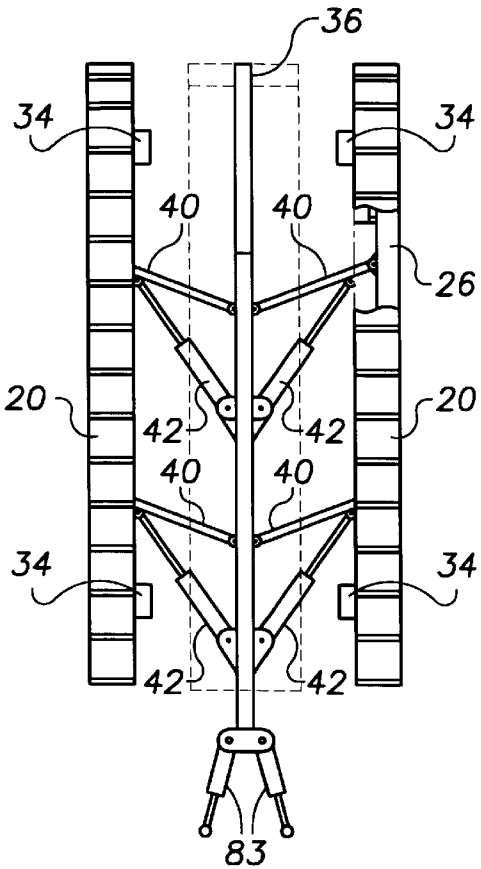
FIG. 4 is a top view of the chassis illustrating width adjustment by broken lines.

A hydraulic motor 34 (FIG. 4) mounted on the inward end of the respective wheel axle 29 drives the chasis 12 as presently explained. The chassis means 12 includes the vertical panel 36, of selected width and thickness, which centrally extends longitudinally edgewise substantially equidistant with the spacing between the forward and rearward limits of the track means 20. Forward and rearward pairs of struts 40 (FIG. 4) extend laterally between and are pivotly connected, respectively, with the chassis panel 36 and the beams 26. Two pairs of hydraulic cylinders 42 are respectively pivotly connected at one end on opposite sides of the panel 36 and are pivotly connected by rod end portions with the pairs of struts 40 for positioning the endless track means 20 adjacent opposite sides of the panel 36 as illustrated by dashed lines (FIG. 4) or in an expanded lateral position as illustrated by solid lines. The endless tracks may be expanded from a minimum spacing position between opposite outer limits of 7.9 cm (20 in.) to 4.4 M (4 ft.).

FRAME MEANS

Figure 3:
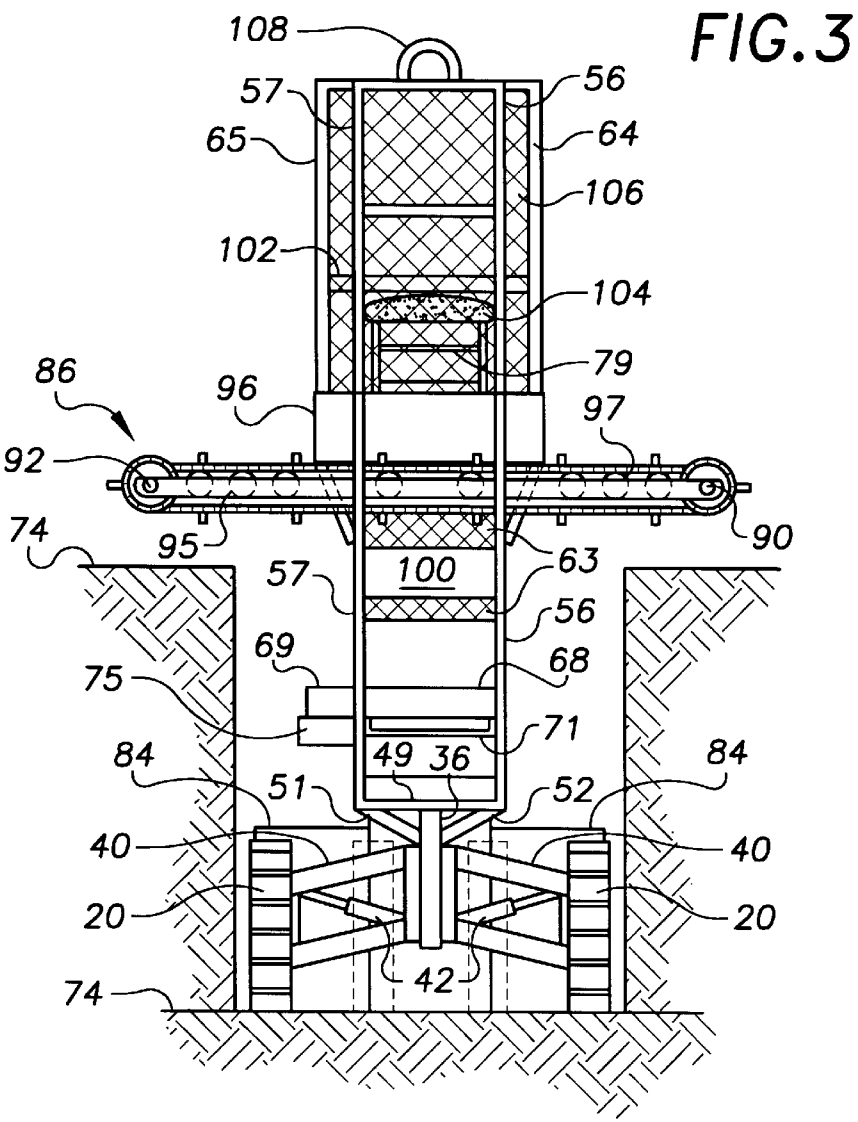
FIG. 3 is a rear elevational view.

The frame means 14 includes a horizontal rectangular base frame 44 having right and left side members 46 and 47, interconnected by end members 48 and 49 and an intermediate member 50 which longitudinally centrally overlies the chassis support panel 36. A plurality of pairs of frame stabilizers 51 and 52 (FIG. 3) are rigidly connected with the respective frame side members 46 and 47 and respective opposite sides of the panel 36 to maintain the frame means 14 vertically upright.

Forward and rearward pairs of frame standards 54–55 and 56–57 respectively extend upright a selected distance from the lateral limits of the forward and rearward ends of the base frame 44. Similarly an intermediate pair of frame standards 58 and 59 project upwardly from an intermediate position of the base frame 44. Right and left horizontal rails 60 and 61 are connected at rearward end portions to the respective one of the pair of intermediate standards 58 and 59 and project forwardly beyond the forward pair of frame standards 54–55 a selected distance and form the base portion of an operator's cage 62 overhanging the forward end portion of the chassis. Forward cage frame standards 64 and 65 project upwardly from the forward end portion of the rails 60 and 61, respectively, equidistant with respect to the upper limit of the frame forward standards 54–55 and intermediate standards 58–59. The upper end portions of the frame standards 54–55 and 58–59 and cage standards 64–65 are interconnected by cross members and a pair of top rails 66–67 to substantially complete the frame means 14.

CONVEYOR MEANS

The conveyor means 16 includes an upwardly and rearwardly inclined trough 70 having upstanding sidewalls 72 and 73. The trough 70 extends from adjacent the ditch bottom 74 between the pairs of frame standards 54–55 and terminates at a position, between the pair of frame standards 58 and 59, above the horizontal plane of the cage rails 60 and 61. The conveyor trough sidewalls 72 and 73 support a pair of forward sprocket wheels 76 on a transverse axle 77 and a pair of sprocket wheels 78 at the rearward upper end on an axle 79. A pair of endless chains 80 extend between and are supported by a portion of the periphery of the respective cooperating sprockets 76 and 78 and are driven by a hydraulic motor 82 connected with the axle 79. A pair of pressure cylinders 83 (FIGS. 1 and 4) on the forward end portion of the panel 36 are connected with the depending end portion of the trough 70 to support the latter adjacent the ditch bottom surface.

Figure 2:
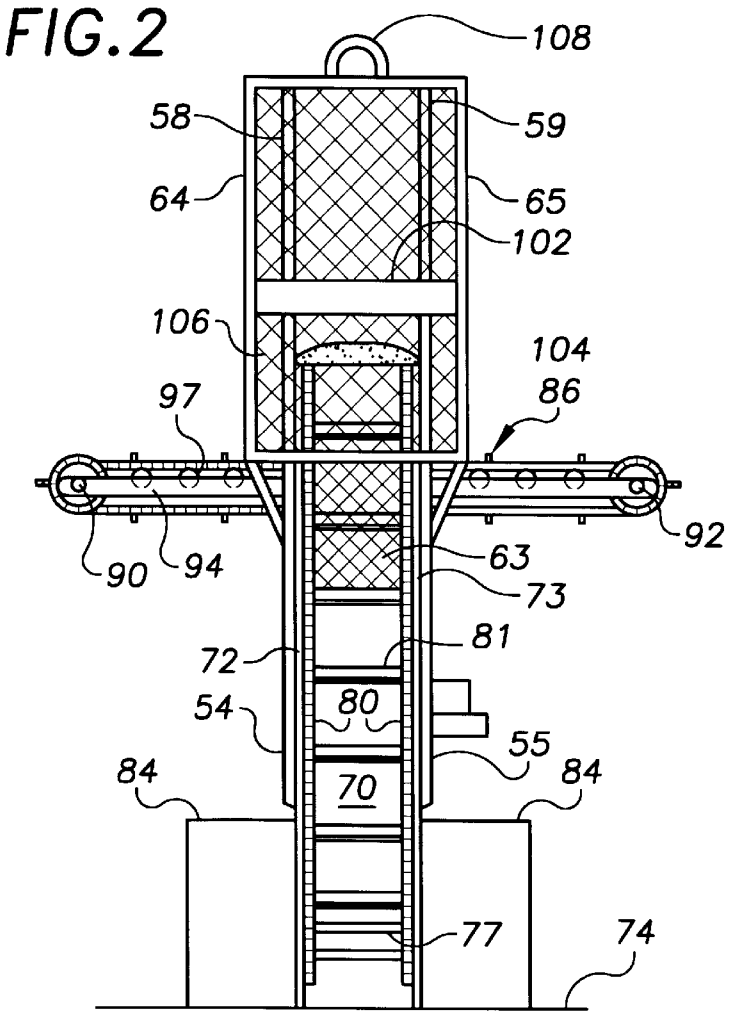
FIG. 2 is a front elevational view.

A pair of debris sweeping wings 84 are hingedly connected, for horizontal pivoting movement about vertical axes, with a respective forward limit of the trough sides 72 and 73. A pair of pressure cylinders 85, only one being shown, are connected between the respective trough sidewall 72 and 73 and the respective wing 84 for moving the later in a lateral direction in accordance with the width of the ditch being cleaned to guide soil, rocks and other debris, not shown, into the forward end of the trough 70. Conveyor cross bars 81 engage loose soil, rocks and other debris and moves it upwardly along the bottom of the trough 70. The upper substantionaly one third the length of the 70 trough bottom is formed from screen material 63, of selected mesh, (FIG. 2) permitting loose soil (not shown) to fall by gravity to a central horizontal, forward-to-rearward, conveyer 68 driven by a hydraulic motor 69, which deposits the loose soil in a rearward receptacle 71, pivoted to empty by a reversible hydraulic motor 75. The receptacle is periodically emptied on the ditch bottom rearwardly of the apparatus 10 to form spaced-apart pipe supporting berms, not shown. Other debris discharged from the conveyor trough 70 falls by gravity on a horizontally disposed conveyor means 86 transversely disposed in the rearward portion of the frame means 14 and projecting at its respective ends, beyond lateral limits of the frame means.

The horizontal conveyor means 86 comprises an endless belt 88 extending around cylinders 90 at respective ends of the conveyor 86 and driven by a hydraulic motor 89 connected with a cylinder 92. The cylinders have axles 91 and 93 which are journaled by elongated conveyor side supports 94 and 95 in turn supported by the frame standards 56–57 and 58–59.

A debris deflecting panel 96, supported by the frame standards 56 and 57, opposite the discharge end of the conveyor trough 70 deflects debris to the surface of the transverse conveyor belt 88. Transverse rollers 97 interposed between the belt 88 and the upper surface of the support members 94–95 support the mass of the debris deposited on the transverse conveyor means 86.

PRIME MOVER

The prime mover means 18 includes a motor 98 supported by the base frame 44 between the intermediate and rearward frame standards 58–59 and 56–57, respectively, and supplied by fuel from a tank 100. The motor 98 drives a hydraulic pump P supplying hydraulic fluid pressure to the respective hydraulic 34 motors driving the chassis wheels, conveyors and pressure cylinders, through control valves, not shown, on a control panel 102 mounted in the operator's cage 62. An operator's chair 104 is mounted in the operator's cage and supported by the frame forward standards 54–55. Expanded metal 106 forms a floor between the rails 60–61 and a wall between the frame standards 54–55 behind the seat 104.

The frame means 14 is further provided with a lifting eye 108 on its upper limit, substantially above the center of gravity so that a crane or the like, not shown, may lift the apparatus 10 into and out of a ditch.

OPERATION

In operation, assuming the apparatus 10 is within a ditch to be cleaned, the operator seated in the operator's cage 62 starts the motor 98 which powers up the hydraulic system. By using the controls of the control panel 102 the track members 20 move the device 10 in a forward direction. The depending end of the conveyor 16 is disposed adjacent the ditch bottom surface 74. The sweep wings 84 are adjusted to position the forward vertical edges in selected spaced relation with respect to the ditch sidewalls. As the device moves in a forward direction rocks and other debris, not shown, are moved by the wings 84 toward the entrance of the conveyor 16 to be picked up by the cross bars 81 and moved up the conveyor trough 70. Loose soil falls on the conveyor 68 and other debris is deposited, by gravity, on the endless conveyor belt 88 and moved to a position laterally of the position of the ditch and apparatus, completing one cycle of operation.

It is believed obvious the apparatus may be employed to remove debris from other soil, such as beach sand.

Obviously the invention is susceptible to changes or alterations without defeating its practicability. Therefore, we do not wish to be confined to the preferred embodiments shown in the drawings and described herein.

We claim:

1. A ditch cleaning machine, comprising: a prime mover driving chassis means including a vertical support panel and laterally spaced forward and rearward pairs of sprocket wheels journaled by stub axles at respective ends of a pair of wheel beams secured to opposite sides of the support panel for respectively driving endless metal belts and longitudinally moving the chassis on a ditch bottom surface;

upright frame means supported by the chassis means and extending a predetermined distance above the upper limit of a ditch to be cleaned;

an operator station adjacent the upper limit of the frame;

elevating conveyor means including a debris receiving trough inclined rearwardly and upwardly a selected distance from the lowermost forward portion of said chassis into said frame means for moving debris through said trough during forward movement of said chassis, said trough having upstanding side walls and having a flat bottom terminating, adjacent the upper limit thereof, in a screen bottom for separating loose soil from other debris;

horizontal belt conveyor means transversely supported by and projecting, at respective end portions, beyond opposite side limits of said frame means for discharging debris, falling by gravity from the uppermost end of said trough, laterally of said frame means;

other horizontal belt conveyor means longitudinally supported by said frame above said chassis for discharging soil, falling by gravity from the screen bottom portion of said trough, rearwardly of said chassis; and, sweep means pivotally secured to the forward end portion of said trough side walls for horizontal pivoting movement about vertical axes and guiding soil and debris toward the elevating conveyor means.

2. The machine according to claim 1 and further including:

receptacle means supported by said frame means adjacent the rearward limit of said other conveyor means for receiving soil discharged from said other conveyor means and periodically dumping said soil on the ditch bottom.

3. The apparatus according to claim 1 and further including:

a hydraulic system including a hydraulic pump;

hydraulic motor means for driving the respective wheel and said elevating and horizontal conveyor means; and, pressure cylinder means for adjusting the position of said elevating conveyor and said sweep means relative to the surface of a ditch bottom.

4. The apparatus according to claim 2 in which said chassis includes:

struts extending horizontally between and pivotally connected at their respective ends with said support panel and said wheel beams; and, other pressure cylinder means extending between said support panel and said struts for adjusting the spacing between said endless metal belts.

* * * * *